United States Patent [19]

Kayne

[11] 4,260,365

[45] Apr. 7, 1981

[54] CANDLE LAMP

[75] Inventor: Marvin L. Kayne, Glenwood, Ill.

[73] Assignee: Valley Candle Mfg. Co., Inc., Brooklyn, N.Y.

[21] Appl. No.: 891,634

[22] Filed: Mar. 30, 1978

[51] Int. Cl.[3] ..... F23D 3/16

[52] U.S. Cl. ..... 431/291; 362/163; 362/161; 248/310; 248/519; D26/11

[58] Field of Search ..... 431/289, 290, 291; 362/161, 162, 163, 412; D48/2; 248/523, 519, 539, 310, 314

[56] References Cited

U.S. PATENT DOCUMENTS

| | | | |
|---|---|---|---|
| D. 92,485 | 6/1934 | Muench | D48/2 |
| D. 153,650 | 5/1949 | Ulvad | D48/2 |
| 1,292,195 | 1/1919 | Will | 362/163 |
| 1,746,966 | 2/1930 | Purcell | 431/289 |
| 2,111,642 | 3/1938 | Saier | 248/519 |
| 2,197,887 | 4/1940 | Elting | 248/310 |
| 2,340,527 | 2/1944 | Guilfoil, Jr. | 362/161 |
| 3,556,704 | 1/1971 | Grasznick | 431/290 |

FOREIGN PATENT DOCUMENTS

| | | | |
|---|---|---|---|
| 362808 | 12/1931 | United Kingdom | 248/310 |

*Primary Examiner*—Samuel Scott
*Assistant Examiner*—Lee E. Barrett
*Attorney, Agent, or Firm*—Jerome Goldberg

[57] ABSTRACT

A candle lamp including securing means for removably attaching a container to a socket. The securing means includes grooves formed in the container for receiving tongues protruding from the inside of a socket. Fingers also protrude inside the socket for gripping the tapered bottom portion of the container. A rib extends outward in the socket for preventing containers smaller than the proper container from being seated upright in the socket. The socket cooperating with the container includes an air circulating pathway for safeguarding the lamp from a harmful build up of heat.

13 Claims, 6 Drawing Figures

CANDLE LAMP

BACKGROUND OF THE INVENTION

This invention relates generally to a securing means for removably attaching a container to a socket, and more specifically relates to a securing means for removably attaching a candle to a holder and includes a tongue received in a groove.

A candle comprising a container with wax or paraffin contained therein, may be placed on a flat surface and be self supporting thereon, or secured in a base and the candle and base combination placed on a flat surface. The base generally provides stability for the candle and also enhances the ornamental and decorative effect of the candle. The subject invention provides a simplified and improved means for removably attaching the container of the candle inside the socket of the base, and for selecting only the proper container to be received and secured in the socket.

It is therefore, a primary object of the invention to provide a securing means for removably attaching a container with wax therein to a socket.

It is another object to provide a container for wax having a plurality of grooves formed around the bottom portion of the container for receiving tongues protruding from the inside of a socket.

Another object is to provide a plurality of gripping fingers around the inside of the socket for retaining the container in place.

Still another object is to provide a container for wax which is tapered at the bottom portion thereof, for cooperating with the gripping fingers for retaining the container in place.

Yet another object is to provide a lamp having a socket for preventing the seating of an improper container which has a circumference at the bottom end less than the circumference of the proper container for the socket. A related object is to provide a socket having at least one protruding rib, to cause tilting and state of instability of such smaller container and thereby preventing the container from seating flatly on the bottom of the socket.

Still another object, which is also related to the last object, is to provide a socket having ledges on which only the proper socket is seated, spaced above the obstruction of the protruding rib.

BRIEF DESCRIPTION OF THE DRAWINGS

Referring now to the drawing in which the same characters of references are employed to indicate corresponding similar parts throughout the several figures of the drawing.

DESCRIPTION OF THE PREFERRED EMBODIMENT

Figure 1:
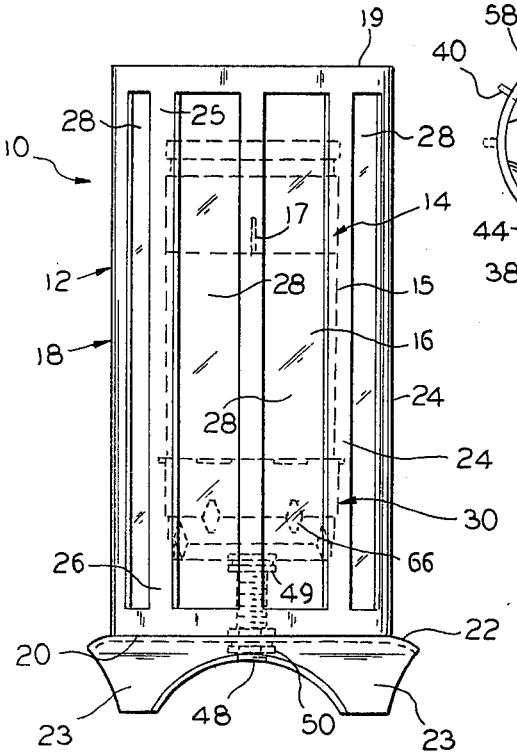
FIG. 1 is a front elevational view of the candle lamp showing the candle in phantom positioned inside the candle holder.
Figure 2:
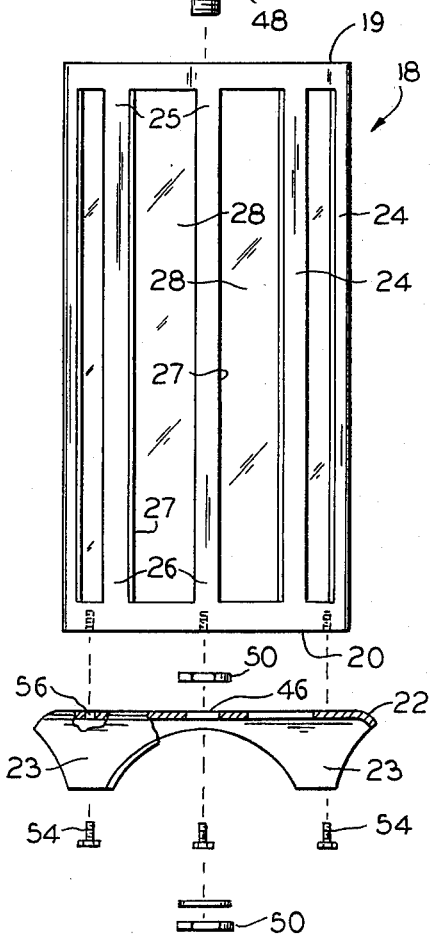
FIG. 2 is an exploded view of the candle lamp.

Referring now to FIGS. 1 and 2 of the drawing, the reference numeral 10 indicates generally a candle lamp device comprising a holder indicated generally by numeral 12 and a removable candle 14. The candle 14 includes a container 15 for holding the paraffin or wax 16. A wick 17 is embedded in the wax 16 and extends outward therefrom.

The holder 12 comprises an elongated and vertical casing 18 having an open top end 19 and an open bottom end 20. A substantially circular support 22 is rigidly secured to the bottom end 20. The support 22 includes four feet 23 extending downward therefrom.

The top and bottom ends 19,20 of the casing 18 have a nine sided shape. Elongated rods 24 are rigidly attached at their upper ends 25 to the top end 19 and at their lower ends 26 to the bottom end 20. The rods 24 may be soldered, welded or otherwise rigidly attached to the ends 19 and 20. The cross section of the attached rods forms a nine sided configuration. The rods 24 cooperating with the top and bottom ends 19,20 define nine rectangular openings 27.

Rectangular strips 28, which may be of a plastic construction, are secured to the rods 24 and span the rectangular openings 27. The strips 28 are translucent and each has a different color, to thereby provide nine different colored windows. Thus, when the candle 14 is burning, multi-colored light is perceived on the outside of the candle lamp 10.

A socket 30 is secured to the support 22 inside the casing 18. The socket 30 includes a bottom 32 having a central opening 33 and a circular side wall 34. Tongues 38,40 and 41 protrude inward from the side wall 34. Arcuate ledges 42 are spaced apart around the inside of the side wall 34 and are located above the bottom 32 of the socket. A plurality of fingers 44 are also spaced apart around the inside of the wall 34, and are positioned above the ledges 42.

A central opening 46 is formed in the support 22. A screw 48 extends through opening 33 and opening 46. Nuts 49 lock the socket 30 in place at the desired level on the screw 48, and nuts 50 secure the screw 48 to the support 22. Threaded holes 52 are formed in the bottom end 20 of the casing 18. Screws 54 pass through apertures 56 formed in the support 22 to be threadedly received in the holes 52, for providing the rigid attachment of the casing 18 to the support 22.

The container 15 of the candle 14 is tapered, so that the circumference at the bottom end 58 of the container is the smallest and progressively increases upward therefrom.

A plurality of grooves 60 are formed inward around the outside of the container 15 at the bottom end 58 of the container 15 and extend vertically upward therefrom. The grooves 60 are arcuate shaped and cooperate with the tongues 38,40 and 41 for removably locking the container 15 inside the socket 30 in the lateral or horizontal plane, and thereby preventing twisting movement of the container 15 inside the socket 30.

Figure 3:
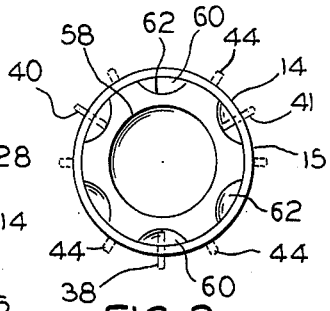
FIG. 3 is a bottom view of the candle taken on the plane of the line 3—3 in FIG. 2, viewed in the direction indicated, and illustrating the plurality of locking grooves and showing the tongues in phantom positioned in the grooves and the gripping fingers in phantom contacting the side of the container.

The longitudinal center 62 of each groove 60 has the deepest inward depression for receiving the tongues 38,40 and 41. Since the depressions on either side of the center 62 are less deep. The tongues 38,40 and 41 are removably locked inside the corresponding groove 60 and the container cannot be twisted free from the socket 30 (see FIG. 3). To insert the container 15 into the socket 30, the container 15 is lowered into the socket 30, so that the grooves 60 receive the tongues 38,40 and 41, and to remove the container 14 from the socket 30, the container is lifted out from the socket 30. The tongues 38,40 and 41 are approximately 120 degrees apart, and can be received by any one of the grooves 60 of the container 15. There are six grooves 60, and, therefore, as seen from FIG. 3, the bottom of the container 15 is substantially hexagonally shaped.

The container 15 as stated above is tapered, but is more pronounced at the lower portion 64 of the container 15 The tapered lower portion 64 is easily lowered into the socket 30 past the fingers 44, and the container is finally gripped by the fingers 44 when the bottom end 58 of the container has reached and is seated on the ledges 42 in the socket 30.

The socket 30 is constructed from a resilient material material such as a plastic. Hence, the socket may be slightly spread outwardly when the container 15 is lowered in place, and the fingers 44 resiliently grip the outside of the container 15.

Vent openings 66 are formed in the side 34 of the socket 30. Since the container 15 is spaced from the bottom 32 of the socket 30, air circulates underneath the bottom 58 of the container 15. Moreover, since the fingers 44 maintain the side of the container spaced from the side 34 of the socket 30, air also circulates between the side 34 of the socket 30 and the outside of the container 15. The vent openings 66 adjacent the bottom 32 of the socket 30 also functions as a space between ledges 42, to provide an air path between the lower portion of the socket 30 and the upper portion of the socket 30 when the container is seated on the ledges 42. Due to these provisions for air circulation, the socket 30 and windows 28 are safeguarded from a build up of intense heat, as the wax burns down toward the bottom of the container 15, which could cause buckling or even melting of the plastic socket 30 and windows 38 of the casing 18.

The vent openings 66 also provides an esthetic sparkling effect of the light when the candle burns near the bottom of the container 15. The diamond shape of the openings 66 further functions to enhance the sparkling effect.

Figure 4:
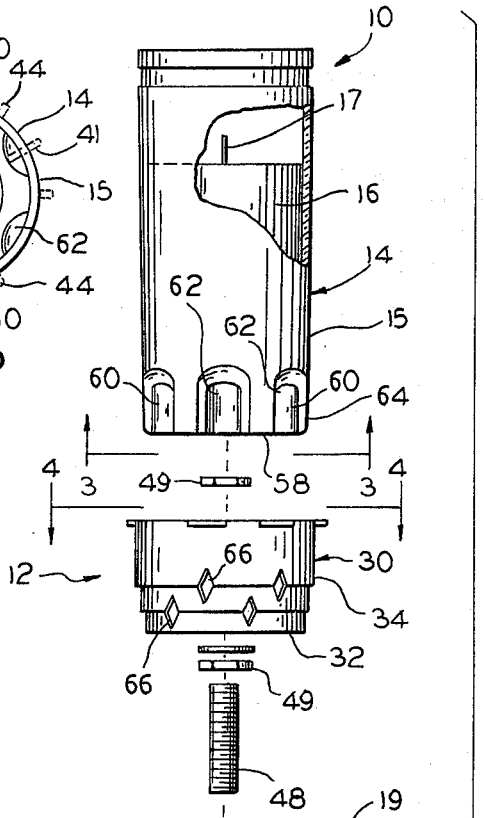
FIG. 4 is a top view of the socket, taken on the plane of the line 4—4 in FIG. 2, and viewed in the direction indicated.
Figure 4:
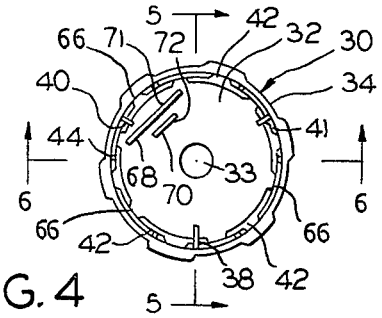
Figure 5:
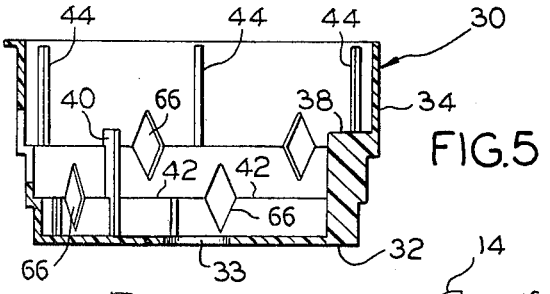
FIG. 5 is an enlarged sectional view of the socket, taken on the plane of the line 5—5 in FIG. 4, and viewed in the direction indicated.
Figure 6:
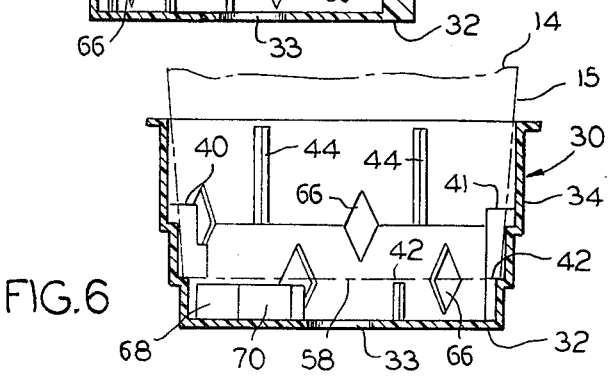
FIG. 6 is an enlarged sectional view of the socket, taken on the plane of the line 6—6 in FIG. 4, and viewed in the direction indicated, and also showing the container in phantom seated in the socket.

Turning now to FIGS. 4 and 6, it will be seen that a rib 68 and a rib 70 protrude upward from the bottom 32 of the socket 30. When the proper container 15 is inserted into the socket 30, the bottom 58 of the container rests on the ledges 42 and the bottom 58 of the container is spaced from the upper edges 71,72 respectively of the ribs 68,70. An improper container which has a smaller circumference than the proper container 15, is prevented from lying flat on the bottom 32 of the socket 30 due to the obstruction caused by the ribs 68,70. If such improper smaller container were attempted to be inserted into socket 30, it would tilt and be unstable due to one part of the bottom of such improper container contacting the upper edge 71 and/or 72 and another part of the bottom of such improper container, being angled and contacting the bottom 32 or the side 34 of the socket 30. Thus, the ribs 68 and 70 discourage the use of a smaller container inside the socket 30 which can not be secured therein.

The tongues 38, 40 and 41 also prevent an improper container, which may even have the same circumference as container 15, from being positioned in the socket 30. Therefore, only the proper container may be seated in the socket 30, and be securely locked in the socket 30, and extend upright in the secured position. Hence, the subject invention provides a lamp which only accepts the proper candle and rejects any other candle.

The description of the preferred embodiment of the invention is intended merely as illustrative of the subject invention, the scope and limits of which are set forth in the following claims.

I claim:

1. A candle and holder comprising:

a container means for containing a burning substance such as wax or the like;

a flexible socket means for receiving said container means, said socket including a bottom end and a circular side wall;

at least one groove formed in one of said means;

at least one tongue protruding from the other of said means, said groove and tongue cooperating to permit said container to be lifted into and out from said socket but preventing twisting motion of said container inside said socket;

a plurality of spaced apart fingers extending inward from the side wall for contacting and spacing the container from the sidewall of the socket; and a plurality of ledges spaced apart and extending inward from the side wall of the socket and positioned upward from the bottom of the socket, the bottom of the container resting on said ledges when the container is positioned in the socket, the spacing between said fingers and ledges enabling air circulation around the lower end of the container.

2. The candle and holder of claim 1, wherein said container is tapered from the bottom thereof to a level above therefrom, so that the smallest circumference of the container is at said bottom and progressively increases above the bottom, said fingers gripping the container above said bottom of the container.

3. The candle and holder of claim 1, wherein a plurality of vent openings are formed in said sidewall of the socket in the spacing between said ledges to extend above and below the bottom of the container when the container is positioned in the socket and on said ledges.

4. The candle and holder of claim 1, wherein a plurality of said grooves are formed in the bottom of the container and extend upward therefrom, a plurality of said tongues extend inward from the inside of said socket for positioning in said grooves, and said plurality of said fingers extend inward from said socket a distance less than the inward extension of said tongues, said tongue being positionable in any of said grooves.

5. The candle and holder of claim 4, wherein said socket includes three said tongues and said container includes six said grooves formed in the bottom of the container and extending upward therefrom, any one of said tongues being positionable in any one of said grooves.

6. The candle and holder of claim 4, wherein the deepest part of said groove is along the longitudinal center thereof to permit passage of said tongue therealong.

7. The candle and holder of claim 1 includes:
a support;
securing means for rigidly attaching the socket to the support; and
a casing encircling said socket and container, said casing being mounted to the support.

8. The candle and holder of claim 1 includes:
a rib protruding upward from the bottom of the socket but not extending above said ledges, for preventing a second container smaller in cross-sectional area than said container means from being positioned upright in said socket, said fingers preventing a third container having a cross-sectional area greater than said container means from being positioned in said socket.

9. The candle and holder of claim 8 includes:
a plurality of ledges extending inward from the side of the socket and being positioned at a vertical level above said rib, the bottom of said container means resting on said ledges and spaced above said rib, when the container means is operatively positioned in the socket.

10. The candle and holder of claim 9 further includes:
spaces separating one ledge from an adjacent ledge;
a plurality of spaced apart fingers for contacting said container and spacing said container from the side wall of the socket; and
vent holes formed in the socket to provide an air circulating path into the socket between the bottom of the socket and the bottom of the container, and communicating with the spaces between ledges, and communicating with the spacing between the container and the side of the socket for communicating with the outside at the top of the socket.

11. The candle and holder of claim 1 includes:
a rib protruding upward from the bottom of the socket to a vertical level not extending above said ledge, the bottom of said container means resting on said ledge and above said rib when the container means is operatively positioned in the socket, said rib preventing a second container unable to rest on said ledge and having a cross-sectional area at the lower end thereof less than said first mentioned container, from being positioned upright and stably on the said bottom of said socket.

12. The candle and holder of claim 7, wherein said securing means includes:
a screw;
an opening formed in the bottom of the socket;
an opening formed in the support, said screw extending through said openings of the socket and the support;
a pair of nuts securing the bottom of said socket to said screw; and
a pair of nuts for securing the screw to said support spaced from said first-mentioned pair of screws.

13. A candle lamp comprising:
a container means for containing a burning substance such as wax or the like;
a socket means for receiving the container means and including a bottom end and a circular side wall;
a plurality of spaced apart ledges protrude inward from the side of the socket at substantially the same vertical level;
a plurality of fingers are spaced apart and protrude inward from the side of the socket and are positioned above the ledges, said fingers being integrally attached to the side wall of the socket, said container being seated on said ledges and said fingers contacting the outside of the container when the container is seated in the socket; and
vent holes formed in the socket in the space between the ledges to provide an air flow to the inside of the socket in the space between the bottom end of the socket and the bottom of the container and through the spaces between the ledges, and in the space between the side wall and the container and between the fingers.

* * * * *